US008747146B2

(12) United States Patent
Brown et al.

(10) Patent No.: US 8,747,146 B2
(45) Date of Patent: Jun. 10, 2014

(54) ELECTRICAL CONNECTOR HAVING CONNECTOR POSITION ASSURANCE

(75) Inventors: Michael Dale Brown, Colfax, NC (US); Hoy Smith Beck, Jr., Lexington, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 83 days.

(21) Appl. No.: 13/462,953

(22) Filed: May 3, 2012

(65) Prior Publication Data

US 2012/0282791 A1 Nov. 8, 2012

Related U.S. Application Data

(60) Provisional application No. 61/482,542, filed on May 4, 2011.

(51) Int. Cl.
*H01R 3/00* (2006.01)

(52) U.S. Cl.
USPC ..... 439/489

(58) Field of Classification Search
USPC ..... 439/489, 352
See application file for complete search history.

(56) References Cited

U.S. PATENT DOCUMENTS 6,435,895 B1 * 8/2002 Fink et al. ..... 439/352

OTHER PUBLICATIONS

Drawing No. C-1419158-1, 1 x 6 Position, Get Female Connector Unsealed, Assembly, Rev. E2, Mar 18, 2002, 1 pg, Tyco Electronics.

* cited by examiner

*Primary Examiner* — Phuong Dinh

(57) ABSTRACT

An electrical connector comprising a housing having at least one terminal receiving passageway, an opening positioned proximate at least one terminal receiving passageway, a primary latch for latching the electric connector to a mating connector, and a slot extending longitudinally along side the primary latch. The connector has a connector position assurance member (CPA) positionable in the opening and having a locking latch which is laterally offset from the primary latch of the housing. The CPA has first and second longitudinal positions. The first position where the CPA is in a partially inserted position and a second position where the housing is in a fully mated position within a mating connector housing and the CPA is in a fully inserted position.

19 Claims, 11 Drawing Sheets

ELECTRICAL CONNECTOR HAVING CONNECTOR POSITION ASSURANCE

BACKGROUND

The subject application relates to electrical connectors, and in particular connectors having assurance of a full mating condition.

Electrical connectors typically include a latch or retention assembly to maintain connector halves in a fully mated position. Some connection systems operate in environments requiring assurance that the connectors are fully mated, typically referred to as connector position assurance. In this case, when the connector halves are mated and the latch or retention assembly is positioned to maintain contact between the connector halves, a connector position assurance member (CPA) may be moved to a position that indicates the connector halves are properly connected. Thus, the CPA provides a means to assure that the connector halves are fully mated. In some situations, the connectors require a low profile configuration.

SUMMARY

An electrical connector comprising a housing having at least one terminal receiving passageway, an opening positioned proximate at least one terminal receiving passageway, a primary latch for latching the electric connector to a mating connector, and a slot extending longitudinally along side the primary latch. The connector has a connector position assurance member (CPA) positionable in the opening and having a locking latch which is laterally offset from the primary latch of the housing. The CPA has first and second longitudinal positions. The first position is where the CPA is in a partially inserted position and the second position is where the housing is in a fully mated position within a mating connector housing and the CPA is in a fully inserted position.

DETAILED DESCRIPTION OF THE DISCLOSED EMBODIMENT

Figure 1:
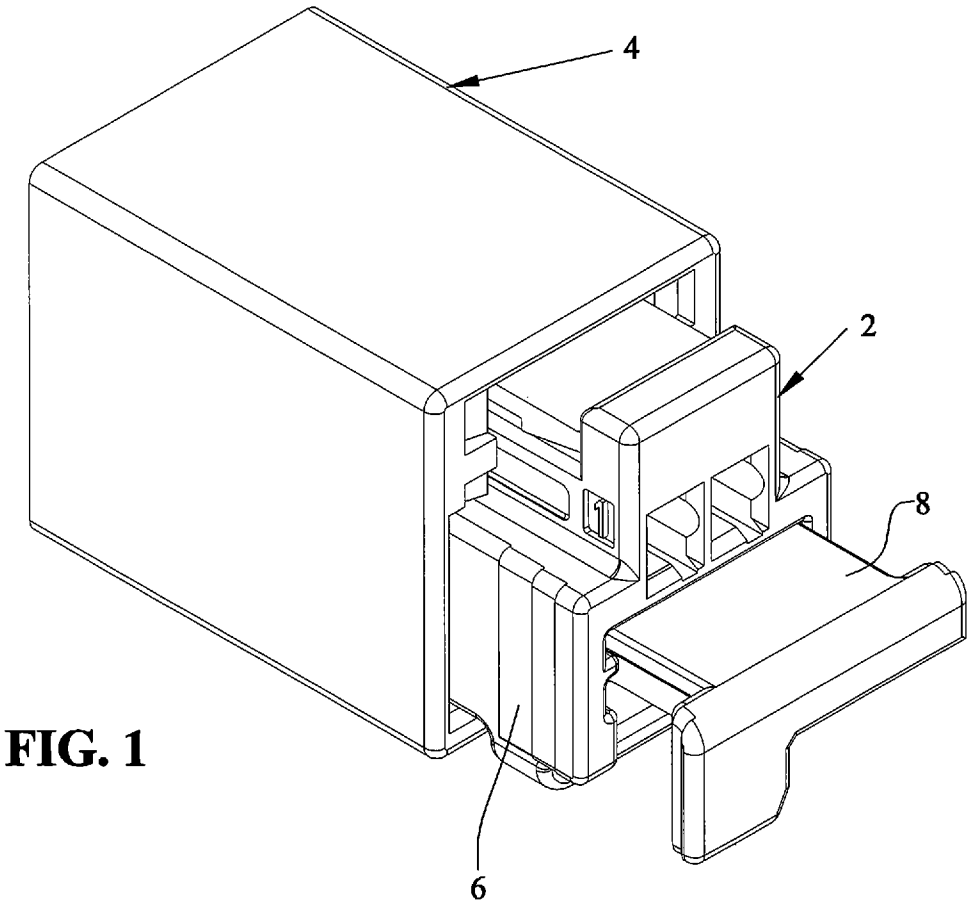
FIG. 1 shows a perspective view of an electrical connector according to the disclosed embodiment interconnected to a mating connector.

With reference first to FIG. 1, an electrical connector is shown generally at 2 interconnected to a mating connector shown at 4. It should be appreciated that mating connector 4 is shown somewhat diagrammatically and could take any form of mating connection device. For example, connector 4 could be a printed circuit board connector where pin or socket terminals within the connector 4 are interconnected to electrical traces on a printed circuit board (not shown). Alternatively, connector 4 could include pin or socket terminals attached to wires, such that the connector assembly including connectors 2 and 4 interconnect wires to each other within a connection system, such as an automobile harness. Alternatively, connector 4 could be integrated with an electrical device such as an electronic control module (ECM) or any other such device.

Figure 2:
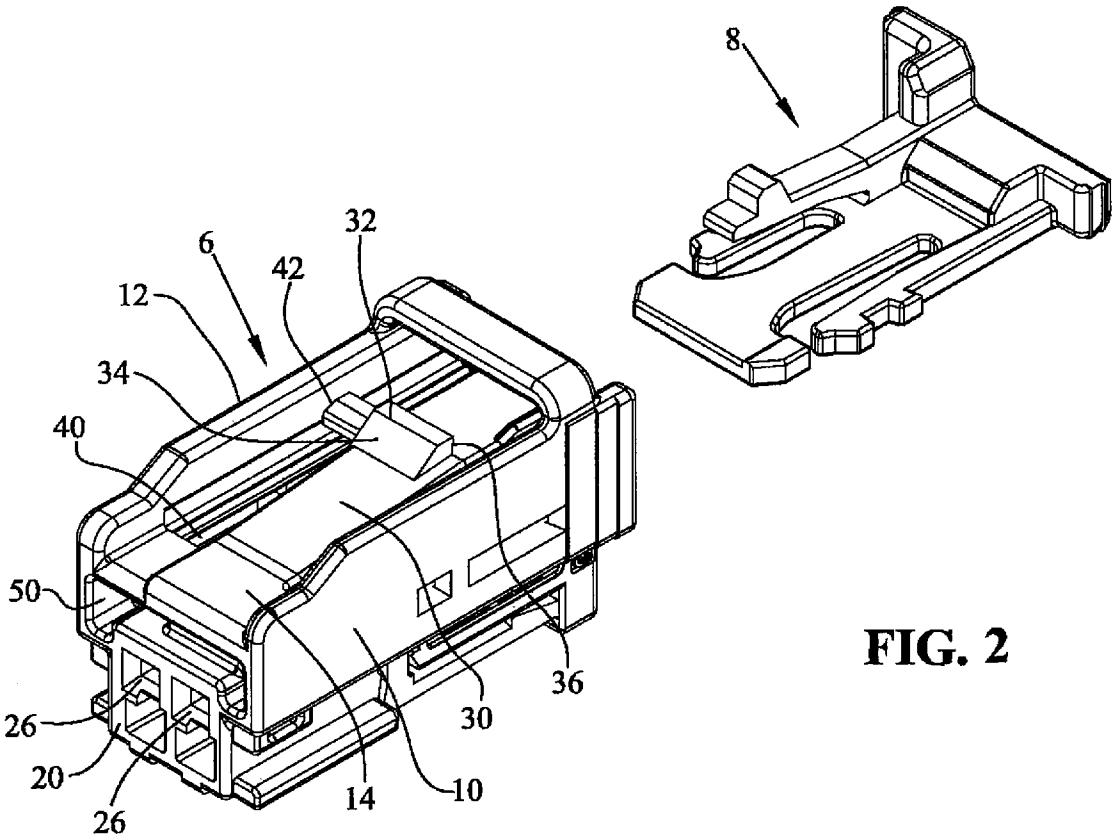
FIG. 2 is a perspective view showing the housing and the connector position assurance (CPA) member exploded away from each other.
Figure 3:
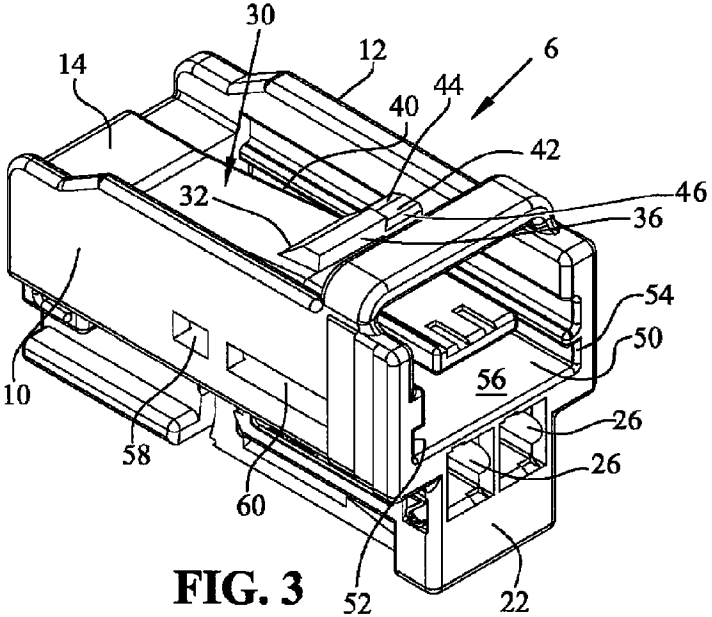
FIG. 3 is a upper perspective view of the housing shown in FIG. 2.
Figure 4:
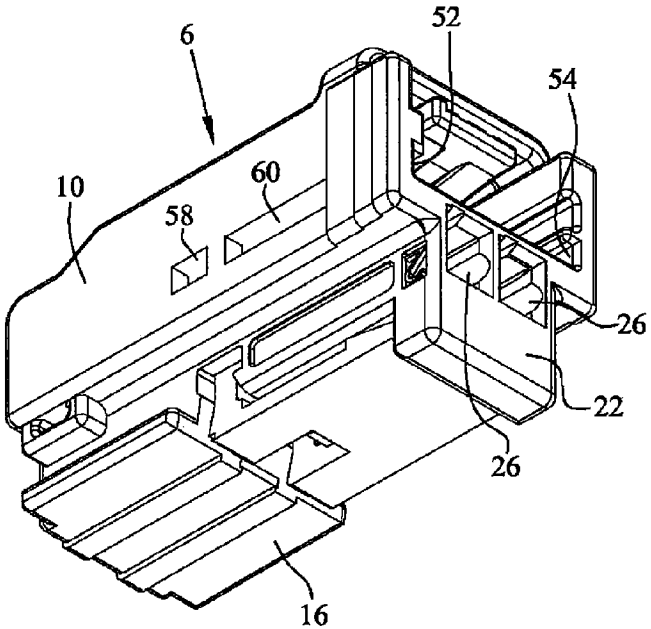
FIG. 4 is a lower perspective view of the housing shown in FIG. 2.
Figure 7:
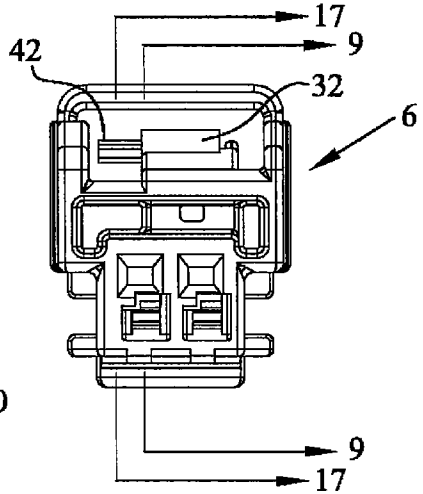
FIG. 7 is an opposite end view of the housing from that of FIG. 5.
Figure 6:
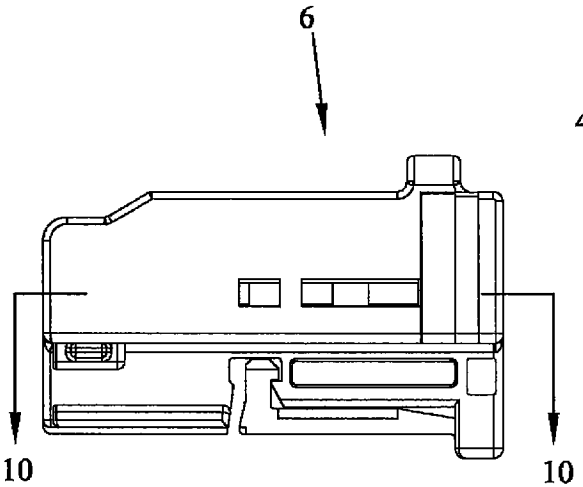
FIG. 6 is a side view of the housing
Figure 5:
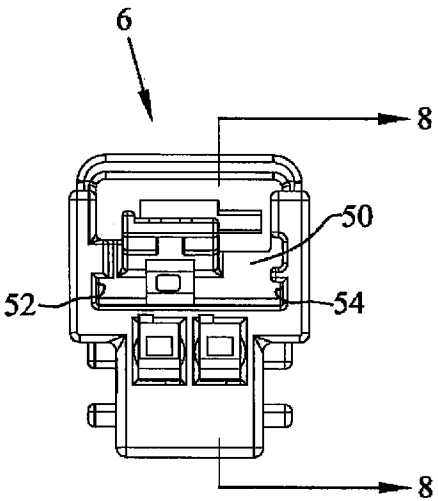
FIG. 5 shows an end view of the housing of FIGS. 3 and 4.

As shown in FIG. 2, electrical connector 2 includes a housing 6 preferably molded from an electrically insulating material such as a plastic material. The electrical connector 2 also includes a connector position assurance member (CPA) 8 as further described herein. With reference now to FIGS. 2-4, electrical connector housing 6 will be described in greater detail.

As shown in FIGS. 2-4, housing 6 includes sidewalls 10, 12, upper wall 14, lower wall 16, front face 20, and rear face 22. It should be noted that the terms front, rear, upper and lower are for relationship descriptions only, as the connector 2 could be in any orientation when in use. Housing 6 also includes at least one terminal receiving passageway 26 extending from rear face 22 to front face 20. As shown, upper wall 14 includes a primary latch 30 defined by a portion of the upper wall 14 having a latching lug 32 having a front ramped surface at 34 (FIG. 2) and a rear locking surface 36 (see also FIG. 9). As shown, primary latch 30 and latching lug 32 are positioned proximate to a lateral centerline of housing 6, and as shown, primary latch 30 and latching lug 32 laterally overlap the lateral centerline.

Figure 8:
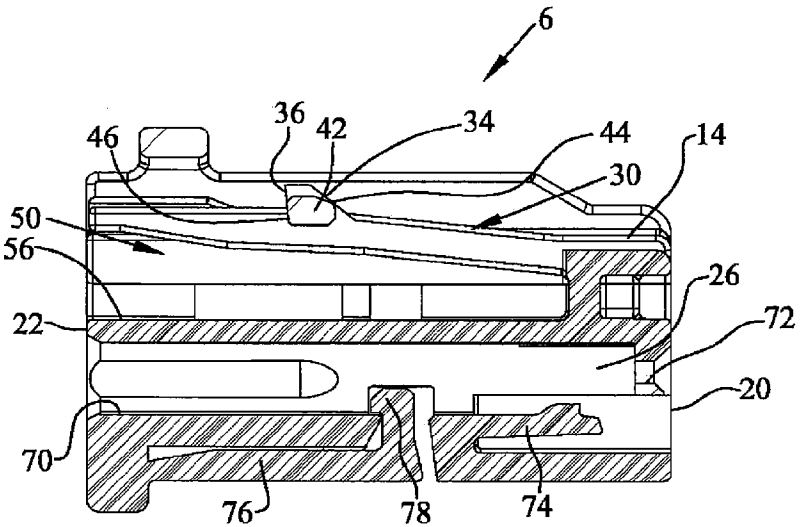
FIG. 8 is a cross-sectional view through lines 8-8 of FIG. 5.

The housing 6 further includes a slot 40 which extends longitudinally along side of primary latch 30. As best shown in FIG. 2, stop member 42 extends integrally from latching lug 32 and spans longitudinal slot 40. Stop member 42 has a front ramped surface 44 and a rear locking surface 46. As shown in FIG. 3, surfaces 36 and 46 are coplanar and laterally aligned. Housing 6 also includes an opening 50 positioned proximate the terminal receiving passageway 26, generally extending from the front face 20 to the rear face 22 and intermediate the upper wall 14 and the terminal receiving passageways 26 (see also FIG. 8). As shown in FIGS. 3-5, 8 and 9, opening 50 is defined by side surfaces 52, 54 lower surface 56 and is positioned under primary latch 30 as best shown in FIG. 8. As best shown in FIGS. 3, 4 and 10, side wall 10 includes openings 58 and 60 and sidewall 12 includes openings 62 and 64 (FIG. 10). Opening 60 has a rear edge 66 defined such that the angle relative to side surface 52 is greater than 270°, as shown in FIG. 10 and as described herein.

Figure 9:
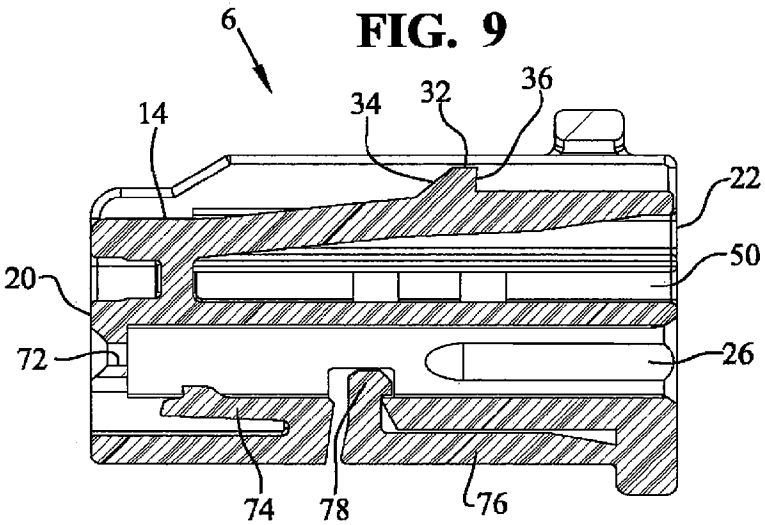
FIG. 9 is a cross-sectional view through lines 9-9 of FIG. 7.
Figure 10:
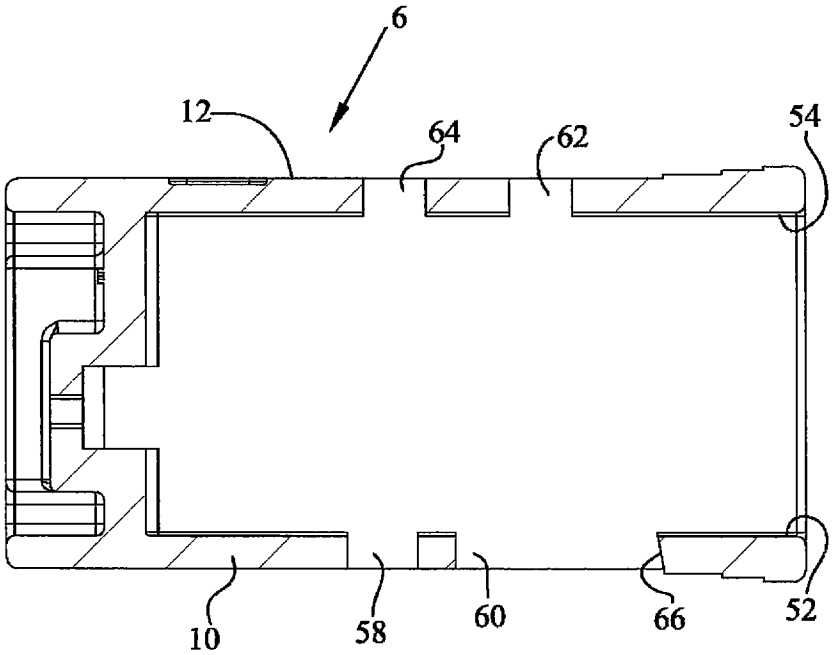
FIG. 10 is a cross-sectional view through lines 10-10 of FIG. 6.

With respect now to FIGS. 8 and 9, terminal receiving passageways 26 are shown in cross-section. A terminal receiving area 70 which extends forwardly towards front face 20. A pin receiving opening at 72 extends from the front face 20. A terminal latch 74 is provided adjacent to terminal receiving passageway 26. The housing 6 also includes an integral secondary lock member 76 having a latching lug at 78.

Figure 11:
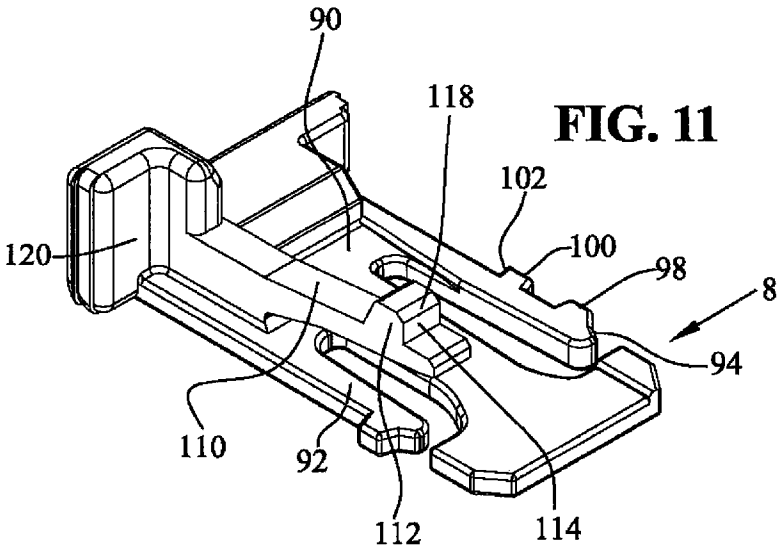
FIGS. 11 and 12 show upper and lower perspective views of the CPA.
Figure 12:
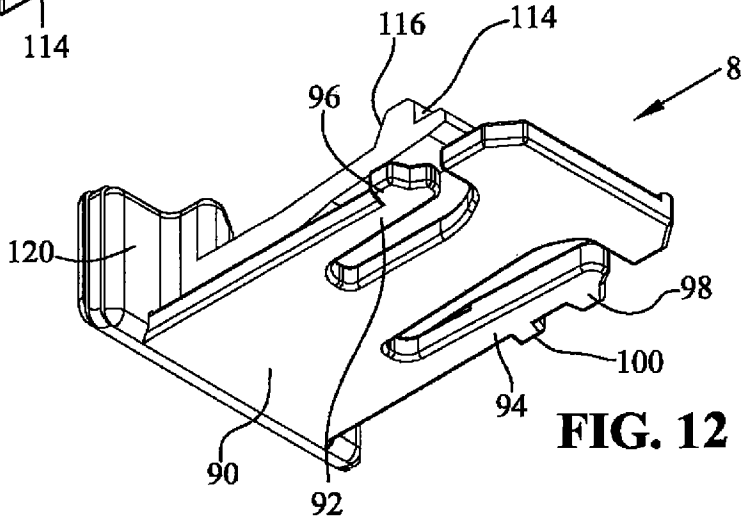

With reference now to FIGS. 11 and 12, CPA 8 includes a planar body portion 90 having a longitudinal centerline. The CPA 8 includes positioning latch arms 92, 94 extending from the planar body portion and movable laterally in the plane of the body portion 90. Latch arm 92 includes a single lug 96 extending out from the latch arm 92 such that when the CPA is moved longitudinally, the lug 96 is movable between openings 62 and 64 (FIG. 12). Latch arm 94 includes a front lug 98 and a rear lug 100 extending out from the latch arm 94. Rear lug 100 includes a rearwardly facing surface 102 which complements rear edge 66 (FIG. 10) of opening 60 as described herein.

CPA 8 further comprises a locking latch 110 extending upwardly from the planar body portion 90 at a position laterally offset from the longitudinal centerline and having a locking lug 112 adjacent a free end. Locking lug 112 has a front edge 114, a rear ramped surface 116 (FIG. 12), and a front ramped surface 118. Locking latch 110 is profiled to be longitudinally slidable within longitudinal slot 40 and thereby laterally offset from the primary latch as described herein. Finally, CPA 8 includes a grip portion 120, having front and rear surfaces allowing the CPA to be pushed or pulled depending on the movement of the CPA desired.

Figure 13:
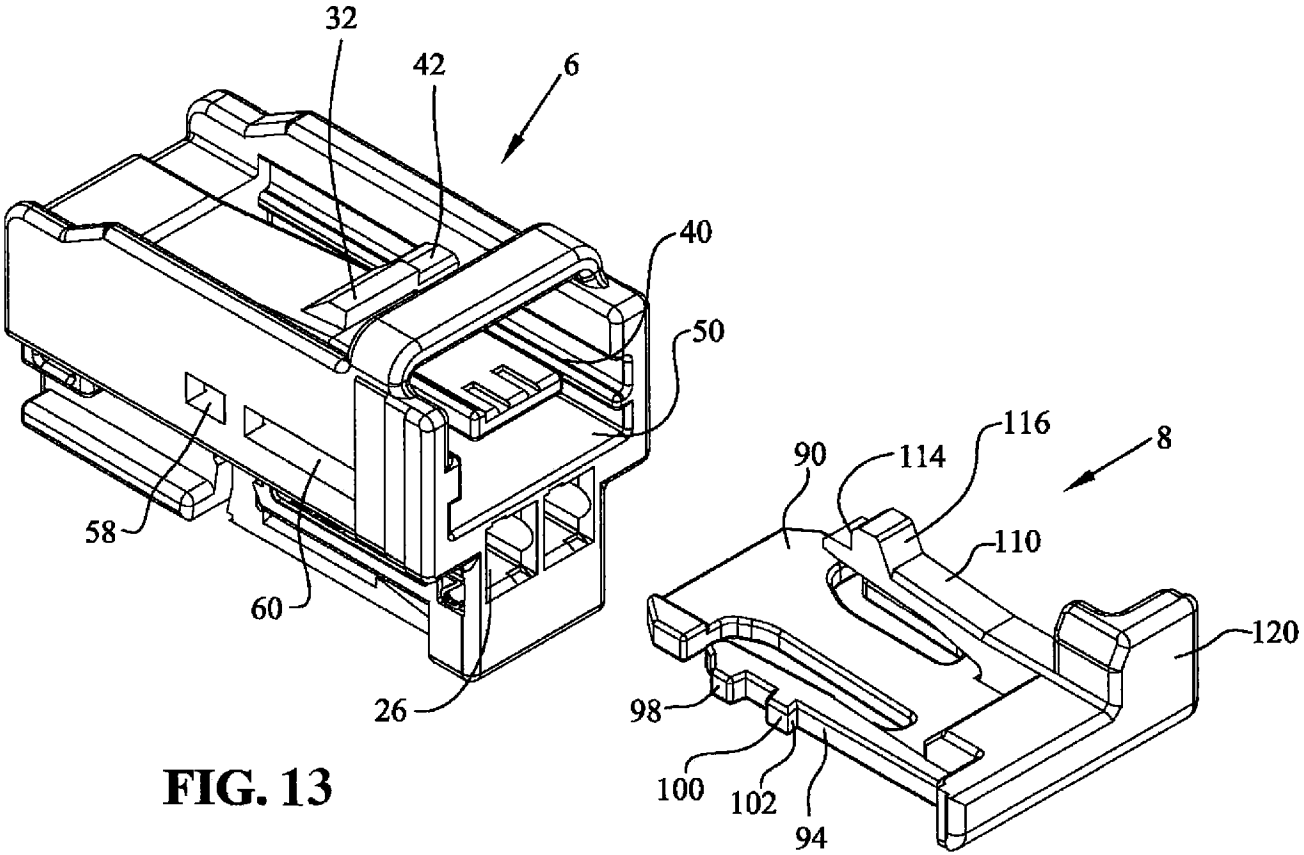
FIG. 13 shows a rear perspective view of the housing and the CPA poised for interconnection with each other.
Figure 14:
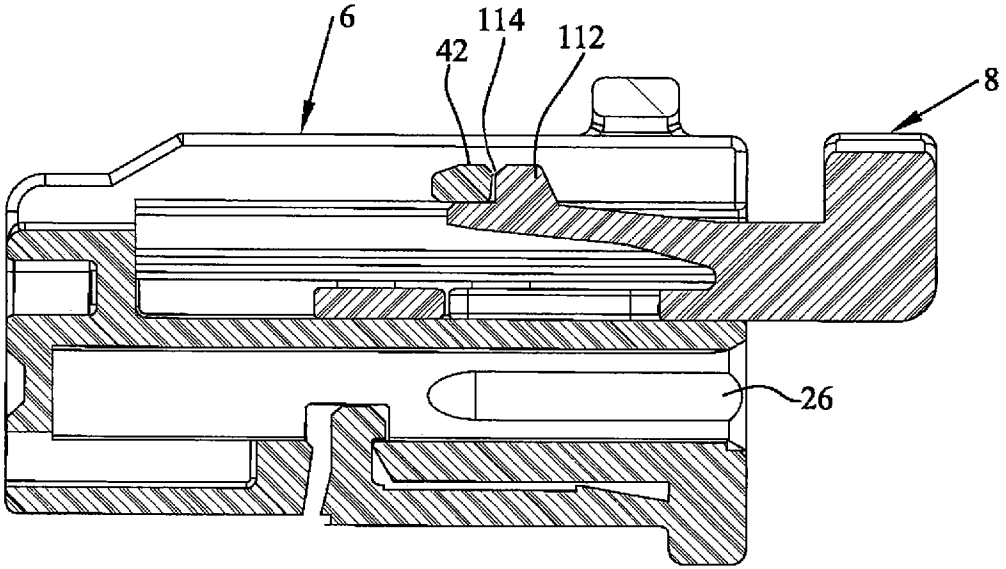
FIG. 14 shows a cross-sectional view of the connector assembly with the CPA is a pre-latched position.
Figure 15:
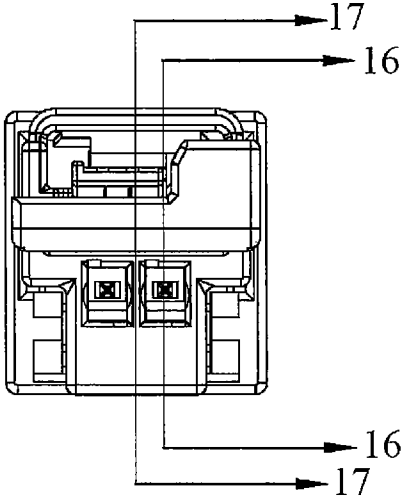
FIG. 15 shows an end view of the connector assembly of FIG. 14, in a partially mated position with a corresponding connector.

With reference now to FIGS. 13-17, the assembly and operation of the connector assembly will now be described. With reference first to FIG. 13, CPA 8 is shown in a position poised to be received within opening 50 of connector housing 6. It should be appreciated that planar body portion 90 is received in the opening 50 with locking latch 110 slideably received in longitudinal slot 40. The CPA 8 is moved longitudinally into a first latch or preassembled position where front lug 98 and rear lug 100 reside within opening 60. As shown in FIG. 14, in the first latch position, the CPA is in a partially inserted position such that the front edge 114 of locking lug 112 of locking latch 110 abuts the rear locking surface 46 of stop member 42. In the first latch position, the rear edge 66 of opening 60 (FIG. 13) and rearwardly facing surface 102 of rear lug 100 (FIG. 13) complement each other, CPA 8 is not easily removed and may be shipped in this preassembled position.

The connector housing 6 is coupled to mating connector 4 having mating terminals or contacts as described above. Prior to mating electrical connector 2 with mating connector 4, one or more terminals, such as socket or pin terminals, may be received in terminal receiving passageways 26 and are locked in place by terminal latch 74 and secondary lock member 76 (FIGS. 8 and 9). When in this position, connector 2 including the housing 6 may be received into a second or fully mated position with mating connector 4 as shown in FIG. 16.

Figure 16:
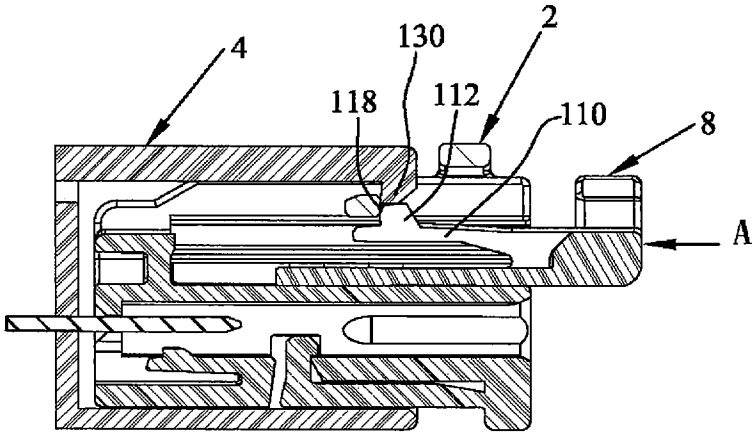
FIG. 16 shows a cross-sectional view through lines 16-16 of FIG. 15.
Figure 17:
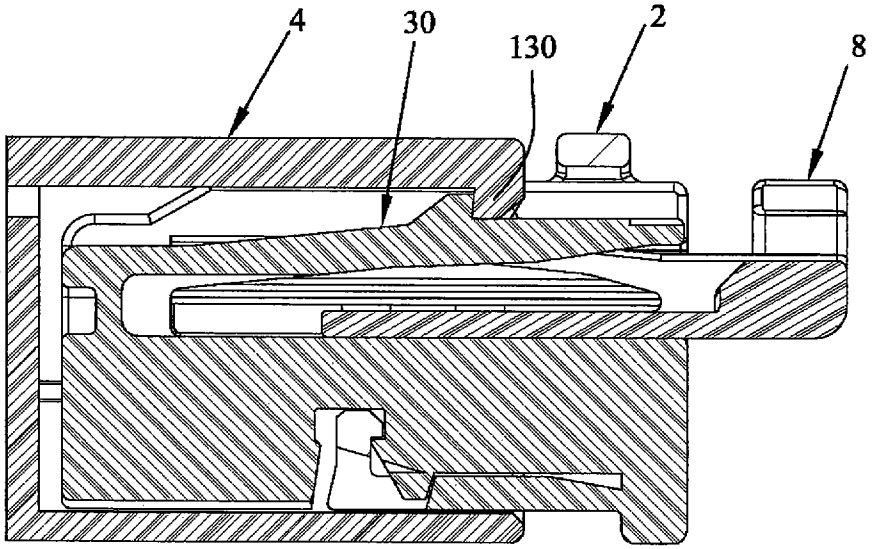
FIG. 17 shows a cross-sectional view through lines 17-17 of FIG. 17.

As shown in FIG. 16, as the connector 2 is coupled to the mating connector 4, a cam member 130 on the mating connector 4 deflects the CPA locking latch 110 downwardly away from the stop member 42. As a further force is applied to the CPA 8 in the mating direction as shown by arrow A, the CPA is moved to a final or fully inserted position as shown in FIG. 17. As best shown in FIGS. 10-13, as the CPA is moved in the mating direction, lugs 96 and 98 (FIGS. 11 and 12) reside in openings 64 and 58 (FIGS. 10 and 13) respectively. In the second or final position, the locking latch 110 is latched so that the locking surface 114 of the locking latch 110 is held adjacent to the front ramped surface 44 of the stop member 42. When in this position the two connectors are in a final and fully latched position, as shown in FIG. 17.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An electrical connector, comprising:

a housing having;

side walls extending longitudinally between a front face and a rear face and being laterally offset from one another;

at least one terminal receiving passageway, an opening positioned proximate the at least one terminal receiving passageway, a primary latch for latching the electrical connector to a mating connector; and a slot extending longitudinally along side the primary latch between the primary latch and one of the side walls; and a connector position assurance member (CPA) being positionable in the opening and having a locking latch which is laterally offset from the primary latch, the locking latch being positioned in the slot along side the primary latch between the primary latch and the corresponding side wall, the CPA having first and second longitudinal positions, where the CPA is in a partially inserted position within the opening in the first longitudinal position, and where the housing is in a fully mated position within a mating connector housing and the CPA is in a fully inserted position within the opening in the second longitudinal position.

2. The electrical connector of claim 1, wherein the CPA comprises a planar body portion having a longitudinal centerline and wherein the locking latch extends upwardly from the planar body portion at a position laterally offset from the longitudinal centerline.

3. The electrical connector of claim 1, wherein the primary latch extends from an upper wall of the housing and is positioned adjacent to a lateral centerline of the housing.

4. The electrical connector of claim 1, wherein the opening is positioned intermediate the upper wall and the terminal receiving passageway.

5. The electrical connector of claim 1, wherein the locking latch is aligned to move longitudinally within the slot as the CPA is moved from the first longitudinal position to the second longitudinal position.

6. The electrical connector of claim 1, wherein a stop member is positioned across the slot, the stop member being profiled for abutment of the CPA locking latch wherein the CPA locking latch abuts against the stop member in the first longitudinal position.

7. The electrical connector of claim 6, wherein the stop member is formed integral with the primary latch.

8. The electrical connector of claim 1, wherein the CPA further comprises one or more latch arms wherein the latch arms comprises one or more lugs extending out from the latch arms.

9. The electrical connector of claim 8, wherein when the CPA is moved from the first longitudinal position to the second longitudinal position the lugs reside within complimentary openings in the housing.

10. The electrical connector of claim 1, wherein the CPA comprises a planar body portion, the locking latch extending from and being spaced apart from the planar body portion, the locking latch being deflectable toward the planar body portion during latching of the electrical connector to the mating connector.

11. The electrical connector of claim 1, wherein the locking latch includes a locking lug proximate to a distal end of the locking latch, the locking lug being positioned rearward of and abutting against a stop member of the primary latch in the first longitudinal position, the locking lug passing under the stop member as the CPA is moved from the first longitudinal position to the second longitudinal position, the locking lug being positioned forward of the stop member in the second longitudinal position.

12. The electrical connector of claim 1, wherein the CPA further comprises a planar body portion having a latch arm extending therefrom, the latch arm having a front lug and a rear lug extending therefrom, the housing including a front opening and a rear opening along the side wall, the front lug and the rear lug being received in the rear opening when the CPA is in the first longitudinal position, the front lug being positioned in the front opening and the rear lug being positioned in the rear opening when the CPA is in the second longitudinal position.

13. The electrical connector of claim 11, wherein the rear opening includes a rear edge cut under and angled non-perpendicular with to the side wall, the rear lug having a complimentary shape to the rear edge to lock the rear lug in the rear opening to stop rearward movement of the CPA with respect to the housing.

14. The electrical connector of claim 1, wherein the housing has a longitudinal centerline centered between the side walls, the primary latch having a primary latch longitudinal centerline offset with respect to the longitudinal centerline of the housing toward the side wall opposite the slot.

15. The electrical connector of claim 13, wherein the CPA comprises a planar body portion having a longitudinal centerline, the locking latch extending from the planar body portion and having a locking latch longitudinal centerline offset from the longitudinal centerline of the planar body portion.

16. The electrical connector of claim 14, wherein the locking latch longitudinal centerline is offset toward one side wall and the primary latch longitudinal centerline is offset toward the other side wall.

17. The electrical connector of claim 1, wherein the primary latch is deflectable in a vertical direction and wherein the locking latch is deflectable in a vertical direction.

18. The electrical connector of claim 16, wherein the locking latch includes a locking lug configured to be positioned below a stop member of the primary latch, wherein the locking latch is deflected downward by the stop member when the primary latch is deflected downward toward an upper wall of the housing during mating of the electrical connector with the mating connector.

19. The electrical connector of claim 1, wherein the primary latch is deflectable in a vertical direction, the locking latch of the CPA being horizontally offset from the primary latch in a lateral direction along side the primary latch in the slot.

* * * * *